US009556745B2

(12) United States Patent
Papin et al.

(10) Patent No.: US 9,556,745 B2
(45) Date of Patent: Jan. 31, 2017

(54) TURBINE ENGINE VANE PLATE SEAL

(75) Inventors: Thierry Georges Paul Papin, Varennes-Jarcy (FR); Lise Lacroix, Melun (FR); Dominique Raulin, Saint Fargeau Ponthierry (FR)

(73) Assignee: SNECMA, Paris (FR)

( * ) Notice: Subject to any disclaimer, the term of this patent is extended or adjusted under 35 U.S.C. 154(b) by 415 days.

(21) Appl. No.: 14/233,549

(22) PCT Filed: Jul. 17, 2012

(86) PCT No.: PCT/FR2012/051690

§ 371 (c)(1),
(2), (4) Date: Jan. 17, 2014

(87) PCT Pub. No.: WO2013/011235

PCT Pub. Date: Jan. 24, 2013

(65) Prior Publication Data

US 2014/0193250 A1 Jul. 10, 2014

(30) Foreign Application Priority Data

Jul. 20, 2011 (FR) ..... 11 56594

(51) Int. Cl.
*F04D 29/38* (2006.01)
*F01D 9/02* (2006.01)
(Continued)

(52) U.S. Cl.
CPC ..... *F01D 9/02* (2013.01); *F01D 5/147* (2013.01); *F01D 9/041* (2013.01); *F04D 29/542* (2013.01);
(Continued)

(58) Field of Classification Search
CPC ..... F01D 9/02; F01D 9/041; F01D 5/147; F01D 5/18; F01D 5/188; F04D 29/542
(Continued)

(56) References Cited

U.S. PATENT DOCUMENTS 5,896,658 A * 4/1999 Calle ..... B21D 26/021 29/889.7
6,039,542 A * 3/2000 Schilling ..... F01D 5/16 416/224
(Continued)

FOREIGN PATENT DOCUMENTS

EP 1 557 529 7/2005

OTHER PUBLICATIONS

U.S. Appl. No. 14/272,911, filed May 8, 2014, Cretin, et al.
International Search Report Issued Nov. 2, 2012 in PCT/FR12/051690 Filed Jul. 17, 2012.

*Primary Examiner* — Nicholas J Weiss
*Assistant Examiner* — Jason T Newton
(74) *Attorney, Agent, or Firm* — Oblon, McClelland, Maier & Neustadt, L.L.P.

(57) ABSTRACT

A plate closes the main part of a vane in two parts. An internal cavity is closed by the plate. Around a bearing surface of the plate, a groove receives an elastic seal, and the outer edge of the plate extends over the groove to compress the seal and to establish excellent leak proofing. The position of the plate may be guaranteed by centring pins penetrating into holes adjacent to the seal and which it fills when the pins have been removed, which completes the closing of the cavity. The plate has application in particular to stationary gas guide vanes in turbine engines.

5 Claims, 3 Drawing Sheets

(51) Int. Cl.
*F01D 5/14* (2006.01)
*F01D 9/04* (2006.01)
*F04D 29/54* (2006.01)

(52) U.S. Cl.
CPC ..... *F05D 2260/96* (2013.01); *Y10T 29/49316* (2015.01)

(58) Field of Classification Search
USPC ..... 415/191, 115, 232, 233
See application file for complete search history.

(56) References Cited

U.S. PATENT DOCUMENTS

| | | | | |
|---|---|---|---|---|
| 6,454,536 | B1 * | 9/2002 | Evans | B29C 39/10 416/224 |
| 6,471,484 | B1 * | 10/2002 | Crall | F01D 5/16 416/229 A |
| 7,736,131 | B1 | 6/2010 | Wilson, Jr. | |
| 8,616,834 | B2 * | 12/2013 | Knight, III | F01D 5/18 415/116 |
| 2005/0254955 | A1 * | 11/2005 | Helder | B23K 20/122 416/233 |
| 2014/0271227 | A1 * | 9/2014 | Radomski | B23P 15/04 416/97 R |
| 2015/0125308 | A1 * | 5/2015 | Radomski | B23P 15/04 416/224 |
| 2015/0132142 | A1 * | 5/2015 | Weisse | F01D 5/147 416/229 R |
| 2015/0252679 | A1 * | 9/2015 | Pope | F01D 5/147 415/183 |
| 2015/0267541 | A1 * | 9/2015 | Hui | F01D 5/141 416/227 R |
| 2016/0024934 | A1 * | 1/2016 | Schwarz | F01D 5/16 60/805 |

* cited by examiner

TURBINE ENGINE VANE PLATE SEAL

The subject of the invention is a turbine engine vane of the type comprising a plate added onto a main structural part of the vane and which can be used in particular for outlet guide vanes (OGV).

An example of such vanes is given in the document EP-A-1 557 529. A cavity is hollowed out in the centre of the main part, and the plate makes it possible to cover it. Ribs borne by the main part extend nevertheless into the cavity and divide its volume. The plate rests on the ribs when it is mounted, which supports it. The document US-A-2010/0247322, which describes an analogous device, may also be cited.

Various methods are used to join the plate to the main part. In the document cited in the latter, friction welding is proposed. Other methods of welding or bonding may also be practiced; but whatever the method used, a leak proof sealing of the cavity consecutive to the assembly is not guaranteed, since the layer of binder installed between the main part and the plate may be rendered discontinuous accidentally, during the coating of the binder or during the assembly method. Another difficulty to overcome is that it is necessary to ensure that the plate is perfectly placed on the main part and that it remains so during the assembly method.

The invention has been conceived to overcome these drawbacks, and it stands out by an excellent precision of position between the main part and the plate prior to their assembly, and by obtaining much surer leak proofing of the cavity after assembly. Another advantage is that the level of vibrations for which the vane is the seat is reduced.

Under a general form, the invention may be defined as a turbine engine vane comprising a main part containing a cavity and ribs extending into the cavity, and a plate joined to the main part while closing the cavity and while resting on the ribs, characterised in that the plate is joined to the main part while resting on a bearing surface of the main part, set back with respect to an outer face of the main part that surrounds it, by a region adjacent to an outer edge of the plate.

The plate is flush with the outer surface of the main part, and the vane thus has a surface of perfect continuity, or nearly so, without final machining. The bearing of the plate on the ribs reduces its possibilities of vibrating. The interleaving of the plate in the bearing surface set back from the outer surface of the main part makes it possible not to expose the leak proofing means to the outer surface and thus reduces the risks that they are damaged accidentally, or eliminated by a final machining of the vane, which is moreover not indispensable in the invention. Another advantage of the interleaving of the plate in the main part is that it may be placed in the correct position without precaution during assembly.

In a preferred embodiment, the outer edge of the plate extends above a groove of the main part which surrounds the bearing surface and is filled by a seal made of elastic material, the seal being compressed by the outer edge. Leak proofing is guaranteed by the compression of the joint by the outer edge of the plate.

The positioning of the plate and of the main part is advantageously procured by centring pins penetrating into aligned holes; it is then advantageous that the seal extends into these holes once the centring pins have been removed.

The holes may extend at the place of the ribs, near to their connection to the actual main part.

Another aspect of the invention is a method characterised in that it consists, after having laid the plate on the ribs and before fixing the plate onto the main part, in introducing centring pins into the aligned holes.

The invention will now be described with reference to the following figures, which give several embodiments thereof for purely illustrative purposes:

Figure 1:
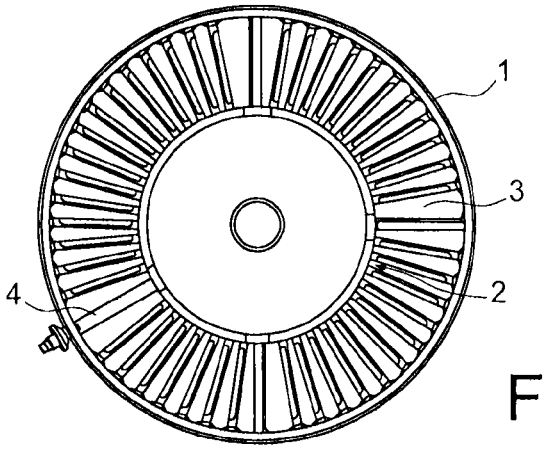
FIG. 1 is a turbine engine part where the invention is present.

FIG. 1 represents an intermediate casing of a turbine engine comprising an outer ferrule 1, an inner ferrule 2 and a circle of vanes 3 arranged between the ferrules 1 and 2. Several radial arms 4 also connect the ferrules 1 and 2 in order to reinforce the assembly. The vanes 3 are arranged through a flow of gas that they contribute to guiding between two stages of moving vanes, as is usual in this type of device.

Figure 2:
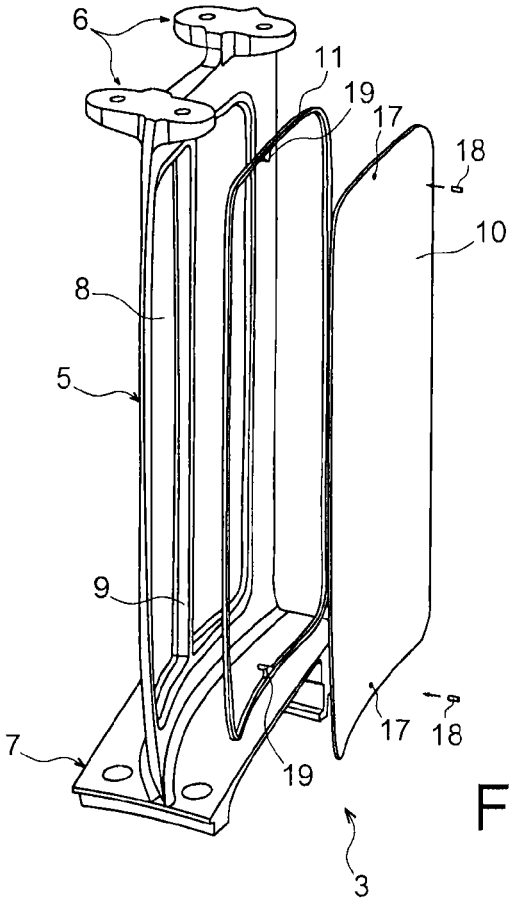
FIG. 2 is an exploded view of a vane according to the invention.

FIG. 2 illustrates the constituents of the vanes 3: there is firstly a main part 5, comprising the largest part of the structure of the vane 3 as well as legs 6 or platforms 7 for assembly by bolting to the ferrules 1 and 2; the main part 5 is continuous on one face of the vane 3 but comprises a cavity 8 which opens out onto the other face. Ribs 9 extend into this cavity 8; their number and their arrangement are not very important and a single rib 9, which extends from the inner edge to the outer edge of the cavity 8, has moreover been represented here; ribs which would not completely pass through the cavity could also be envisaged.

The other elements of the vane 3 are a smooth plate 10 that is assembled to the main part 5 while closing the cavity 8 and an elastomer seal 11, the shape of which corresponds to the contour of the plate 10.

Figure 3:
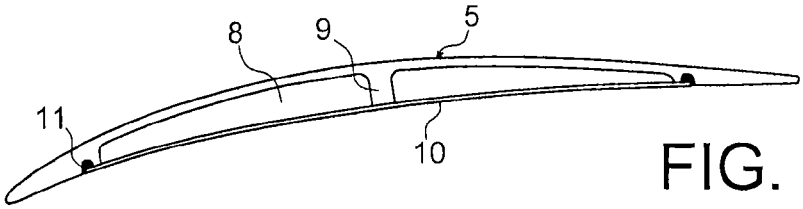
FIG. 3 is a section of the vane.
Figure 4:
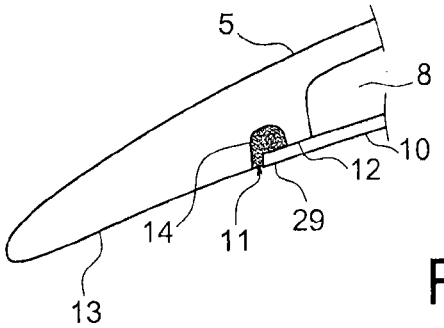
FIG. 4 is a detail of FIG. 3.

Other details of the invention will now be described by means of FIGS. 3 and 4. The plate 10 rests on the ribs 9 as well as on a bearing surface 12 of the main part 5 when it is installed; the bearing surface 12 is set back with respect to the outer face 13 of the main part 5, such that the plate 10 is flush with said outer face 13 and that the vane is smooth and enables a good flow of gases. The seal 11 is housed in a groove 14 of the main part 5 which extends all around the span 12. The outer edge of the plate 10 compresses the seal 11, which is made of elastomer or another elastic material, while extending above the groove 14, and it is thus a part adjacent to this outer edge 29 which rests on the bearing surface 12.

Figure 5:
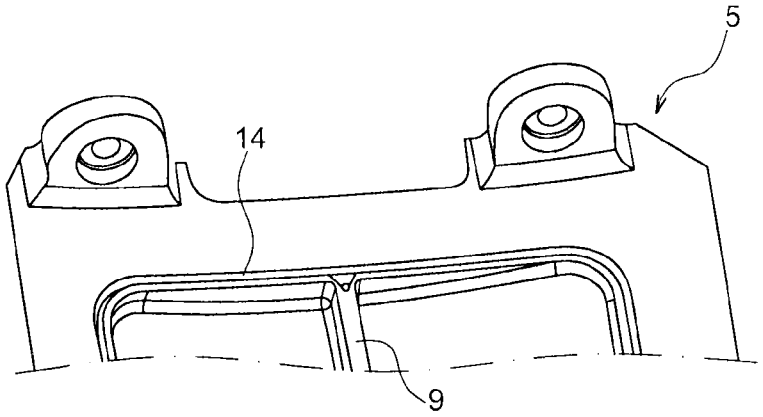
FIGS. 5 and 6 are details of the main part of the vane.
Figure 6:
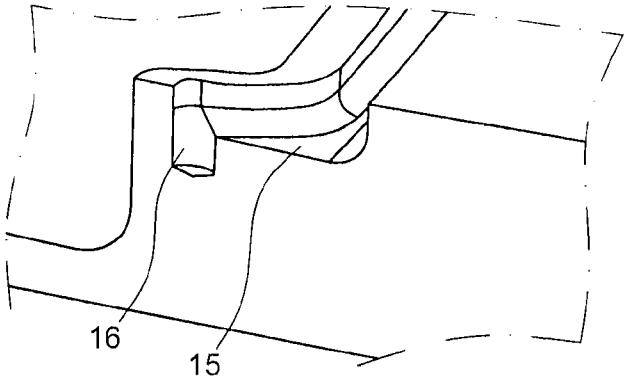

FIGS. 5 and 6 represent other further details of the invention. The groove 14 has a projection 15 at the places where it extends in front of the connections of the rib 9 to the edge of the main part 5, and the end of the projection 15, which extends onto the rib 9, comprises a recessed hole 16. Holes 17 are moreover established at corresponding places through the plate 10 on assembly of the plate 10 on the main part 5, the holes 16 and 17 are aligned, and the introduction of centring pins 18 in these alignments guarantees a correct invariable position of the plate 10 until it is fixed definitively to the main part 5 (FIG. 2). The fixing method may be accomplished by bonding, or any brazing or welding method: a welding by electron beam at the place of the bearing surface 12 and of the rib 9 may be envisaged. The assembly surfaces have been coated with binder as is known in the prior art. The centring pins 18 are removed after fixing. It will be noticed in FIG. 2 that the seal 11 has bulges 19 at the place of the projections 15, said bulges 19, compressed beforehand by the centring pins 18, penetrate to the bottom of the projections 15 as soon as these pins have been removed, sealing off the holes 16 and 17 so as to reinforce the leak proofing and to improve the appearance of the vane.

Figure 7:
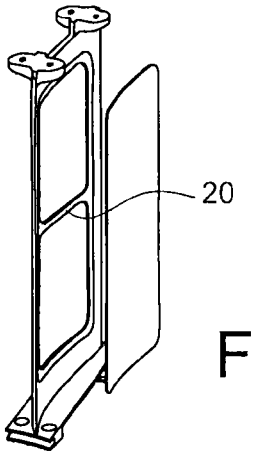
FIGS. 7 to 9 illustrate alternative embodiments for the ribs of the vanes.
Figure 8:
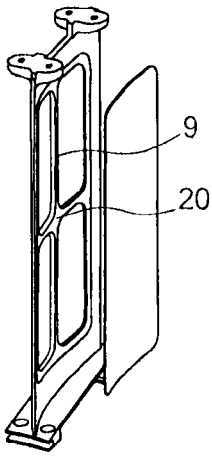
Figure 9:
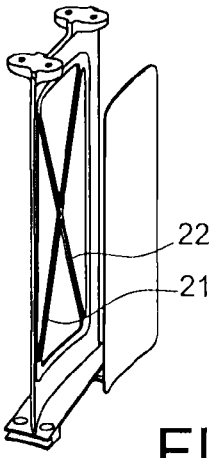

FIGS. 7 to 9 illustrate several other possible arrangements for the ribs: respectively a rib 20 in transversal direction of the vane 3, with invariable radius in the machine; a cross arrangement comprising both the ribs 9 and 20; and another cross arrangement, arranged in an X from where two ribs 21 and 22 extend diagonally through the cavity 8. The other characteristics of the invention are not modified, with the optional exception of the position of the assembly points using the centring pins 18, that it is always advantageous to establish a connection between the ribs and the main part 5 by holes situated in the rib (for the main part) and in front of it (for the plate); but the precision of the assembly remains.

The invention claimed is:

1. A turbine engine vane, comprising:

a main part containing a cavity and ribs extending into the cavity; and a plate joined to the main part while closing the cavity and while resting on the ribs, wherein the plate is joined to the main part while resting on a bearing surface of the main part, the bearing surface is set back with respect to an outer face of the main part that surrounds the main part, by a region adjacent to an outer edge of the plate, and wherein the outer edge of the plate extends above a groove of the main part which surrounds the bearing surface and is filled by a seal made of elastic material, the seal being compressed by the outer edge.

2. The turbine engine vane according to claim 1, wherein the seal extends into aligned holes of the main part and of the plate, used to center the plate with respect to the main part and next to the groove.

3. The turbine engine vane according to claim 2, wherein the aligned holes extend into and in front of the ribs.

4. A method of manufacturing a turbine engine vane comprising a main part containing a cavity and ribs extending into the cavity, and a plate joined to the main part while closing the cavity and while resting on the ribs, wherein the plate is joined to the main part while resting on a bearing surface of the main part, the bearing surface is set back with respect to an outer face of the main part that surrounds the main part, by a region adjacent to an outer edge of the plate, wherein the outer edge of the plate extends above a groove of the main part which surrounds the bearing surface and is filled by a seal made of elastic material, the seal being compressed by the outer edge, and wherein the seal extends into aligned holes of the main part and of the plate, used to center the plate with respect to the main part and next to the groove, the method comprising:

introducing, after having laid the plate on the ribs and before fixing the plate onto the main part, centering pins into the aligned holes.

5. A method of manufacturing a turbine engine vane comprising a main part containing a cavity and ribs extending into the cavity, and a plate joined to the main part while closing the cavity and while resting on the ribs, wherein the plate is joined to the main part while resting on a bearing surface of the main part, the bearing surface is set back with respect to an outer face of the main part that surrounds the main part, by a region adjacent to an outer edge of the plate, wherein the outer edge of the plate extends above a groove of the main part which surrounds the bearing surface and is filled by a seal made of elastic material, the seal being compressed by the outer edge, wherein the seal extends into aligned holes of the main part and of the plate, used to center the plate with respect to the main part and next to the groove, and wherein the aligned holes extend into and in front of the ribs, the method comprising:

introducing, after having laid the plate on the ribs and before fixing the plate onto the main part, centering pins into the aligned holes.

* * * * *